US009066639B2

(12) United States Patent
Hagleitner

(10) Patent No.: US 9,066,639 B2
(45) Date of Patent: Jun. 30, 2015

(54) METHOD OF DISPENSING PAPER SHEET BY SHEET FROM A STOCK AND A PAPER DISPENSER

(71) Applicant: Hans Georg Hagleitner, Zell Am See (AT)

(72) Inventor: Hans Georg Hagleitner, Zell Am See (AT)

( * ) Notice: Subject to any disclaimer, the term of this patent is extended or adjusted under 35 U.S.C. 154(b) by 437 days.

(21) Appl. No.: 13/658,016

(22) Filed: Oct. 23, 2012

(65) Prior Publication Data

US 2013/0043265 A1 Feb. 21, 2013

Related U.S. Application Data

(63) Continuation of application No. PCT/AT2011/000200, filed on Apr. 21, 2011.

(30) Foreign Application Priority Data

Apr. 23, 2010 (AT) ..... A 669/2010

(51) Int. Cl.
*B65H 20/02* (2006.01)
*A47K 10/36* (2006.01)

(52) U.S. Cl.
CPC ..... *A47K 10/36* (2013.01)

(58) Field of Classification Search
CPC ..... A47K 10/34; A47K 10/36
USPC ..... 242/564, 564.1, 564.3, 564.4, 564.5, 242/565, 563, 563.2
See application file for complete search history.

(56) References Cited

U.S. PATENT DOCUMENTS

| | | | | |
|---|---|---|---|---|
| 3,730,409 | A | 5/1973 | Ratti | |
| 6,736,348 | B1 * | 5/2004 | Formon et al. | 242/560.1 |
| 7,637,190 | B2 * | 12/2009 | Granger | 83/337 |
| 7,793,882 | B2 * | 9/2010 | Reinsel et al. | 242/563 |
| 2003/0116003 | A1 * | 6/2003 | Kapiloff | 83/649 |
| 2003/0167893 | A1 | 9/2003 | Morris et al. | |
| 2005/0109789 | A1 * | 5/2005 | Nagayoshi | 221/32 |
| 2007/0194166 | A1 | 8/2007 | Reinsel et al. | |
| 2007/0241160 | A1 | 10/2007 | Kenney | |
| 2008/0128446 | A1 | 6/2008 | Kuehneman et al. | |

FOREIGN PATENT DOCUMENTS

| | | | |
|---|---|---|---|
| DE | 102007060402 | A1 | 6/2009 |
| JP | 2004024378 | A | 1/2004 |
| WO | 2008/042962 | A2 | 4/2008 |

* cited by examiner

*Primary Examiner* — William A Rivera
(74) *Attorney, Agent, or Firm* — Laurence A. Greenberg; Werner H. Stemer; Ralph E. Locher

(57) ABSTRACT

A method and a dispenser dispense a sheet of paper through a bottom outlet gap from a stock. A sensor activates, upon detection of a person, an electric drive which delivers a portion of paper from the outlet gap so that the sheet of paper can be torn off by hand. When the delivered sheet of paper is torn off, a switch is actuated. Actuation of the switch puts the dispenser in an operational readiness for delivery of another portion of paper.

2 Claims, 4 Drawing Sheets

METHOD OF DISPENSING PAPER SHEET BY SHEET FROM A STOCK AND A PAPER DISPENSER

CROSS-REFERENCE TO RELATED APPLICATION

This application is a continuation, under 35 U.S.C. §120, of copending international application No. PCT/AT2011/000200, filed Apr. 21, 2011, which designated the United States; this application also claims the priority, under 35 U.S.C. §119, of Austrian patent application No. AT A669/2010, filed Apr. 23, 2010; the prior applications are herewith incorporated by reference in their entireties.

BACKGROUND OF THE INVENTION

Field of the Invention

The invention relates to a method of dispensing paper sheet-by-sheet from a dispenser set to an operational-standby mode, and to a dispenser for dispensing a sheet of paper from a roll. The dispenser has a discharging gap on the underside, an electric drive and a sensor, which, upon sensing a person, causes the electric drive to feed a length of paper out of the discharging gap, and therefore the paper sheet can be torn off by hand.

Paper dispensers which automatically discharge paper in a contactless manner as soon as a person is at the correct distance from the sensor have the disadvantage that the next length of paper is fed even when the previous sheet has not (yet) been torn off and a person moves into the sensing region of the sensor purely by chance. This means that the paper can become dirty before it has been used, and this increases the consumption.

SUMMARY OF THE INVENTION

The invention, then, has the object of finding a solution to this, and proposes that, once the length of paper has been fed, the operational-standby mode is interrupted until the paper sheet supplied has been removed, and therefore each following length of paper is fed only once the previously fed paper sheet has been removed. Therefore the drive cannot be activated as long as the sheet which is hanging out has not been removed. A dispenser which is suitable for this purpose provides, according to the invention, a switch which is actuated by virtue of the paper sheet being torn off and the actuation of which sets the dispenser into operational-standby mode in order to feed a further length of paper.

In order for the projecting sheet of paper to be torn off by hand, the person grips the free end thereof and subjects it to a pulling force of which the magnitude is dependent essentially on whether the dispenser contains a roll with a paper web which has tear-off perforations or with a paper web which, with the exception of at least one narrow crosspiece, is severed by a blade device. The sheet which is hanging out loosely always has to be tensioned at least to a slight extent, and the tensioning in the paper is detected and used for re-establishing the operational-standby mode.

The switch provided here may be of any desired type; it is preferably mechanical and is provided in the region of a discharging roller of the dispenser, at a location along the course taken by the paper in the vicinity of the discharging gap from the housing, at which the length of paper is pushed out freely. The switch here is coordinated such that the weight of the length of paper which is hanging down is not itself sufficient to actuate the switch.

The switch preferably contains a more or less balanced two-armed lever, of which the end in the final circumferential portion of the discharging roller, before the length of paper hangs down freely, projects beyond the circumference of the discharging roller, and therefore the non-loaded length of paper is raised off from the circumference of the roller. As soon as, then, a person pulls by hand the length of paper which is hanging down, the lever is pivoted, and therefore the projecting end thereof is lowered into the circumferential surface of the discharging roller. The movement of its other end is transmitted, in particular in a contactless manner, to a component which then reactivates the operational-standby mode.

The switch may be, as mentioned, of any desired type and the effect triggered thereby consists exclusively in re-establishing the operational-standby mode, which has been interrupted by the drive motor being at a standstill.

It would be conceivable, for example, for the drive motor, at the end of its feeding phase, to actuate an interrupter for the power supply of the dispenser as a whole, or of the motor alone, and for the switch on the discharging roller to switch on this power supply again.

In another embodiment, it is also possible for the operational-standby mode to be interrupted in that the sensor for sensing a person is deactivated by the sensing operation and is reactivated by the switch on the discharging roller.

If, for the case of a paper jam or of some other problem, the dispenser is provided with an emergency-actuation lever, which bypasses the motor drive and feeds at least one length of paper, then it is preferably provided that the switch can also be actuated by the emergency-operation lever in order to have the dispenser in operational-standby mode once the problem has been eliminated.

Other features which are considered as characteristic for the invention are set forth in the appended claims.

Although the invention is illustrated and described herein as embodied in a method of dispensing a paper sheet by a sheet from a stock and a paper dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
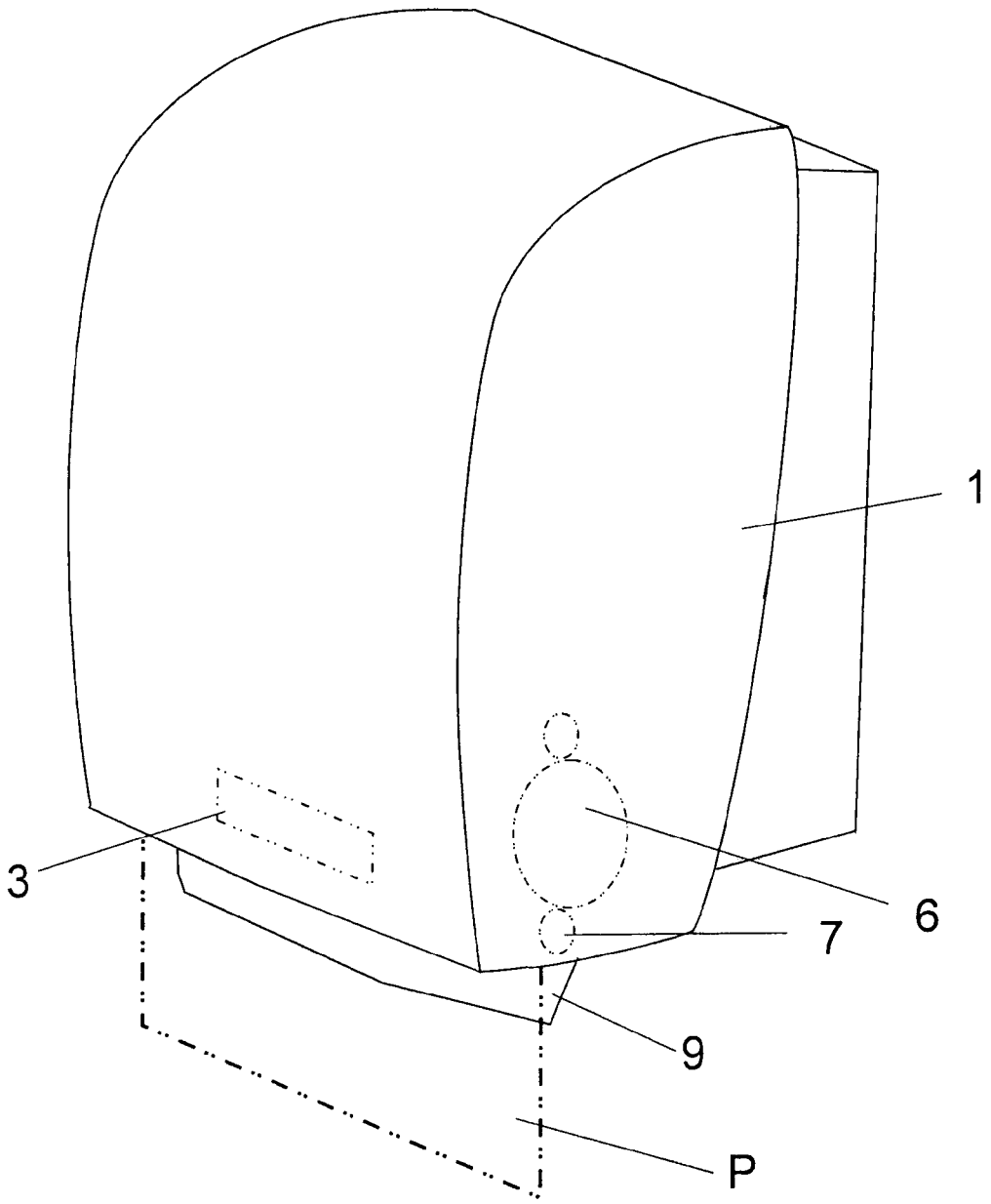
FIG. 1 is a diagrammatic, perspective view of a paper dispenser according to the invention.

Referring now to the figures of the drawing in detail and first, particularly, to FIG. 1 thereof, there is shown a paper dispenser, for example for paper hand towels or the like, has a housing 1 which can be closed by an openable covering and on the underside of which is provided a discharging gap 2 (see FIG. 2), through which paper P is dispensed out of the dispenser. The paper dispenser operates in a contactless manner, since a sensor 3 (indicated only schematically) is arranged, in particular, in the vicinity of the discharging gap 2 and, when it senses a person in its vicinity, causes an electric motor, via a corresponding electronic control device, to feed a length of paper P out of the discharging gap 2. The motor is brought to a standstill again at the end of the feeding operation. The paper P is pulled off from a roll inserted in the housing 1, the paper either being provided with transverse perforations or running through a cutting device, for example a blade roller 6, which is shown in simplified form in FIGS. 2 to 4, which cuts along most of the width of the paper. At least one uncut region remains, and therefore the sheet still hangs on the paper web when a length has been fed (FIGS. 1 and 2); this therefore likewise constitutes a kind of transverse-perforation formation, albeit one which is produced initially in the dispenser.

In the final section of the course taken by the paper upstream of the discharging gap, the paper web runs over a driven discharging roller 7, wherein it is pushed in the conveying direction downstream of a gap 16 between the rollers 6, 7 and drops down freely, and is therefore free of tensioning in this final section.

Figure 2:
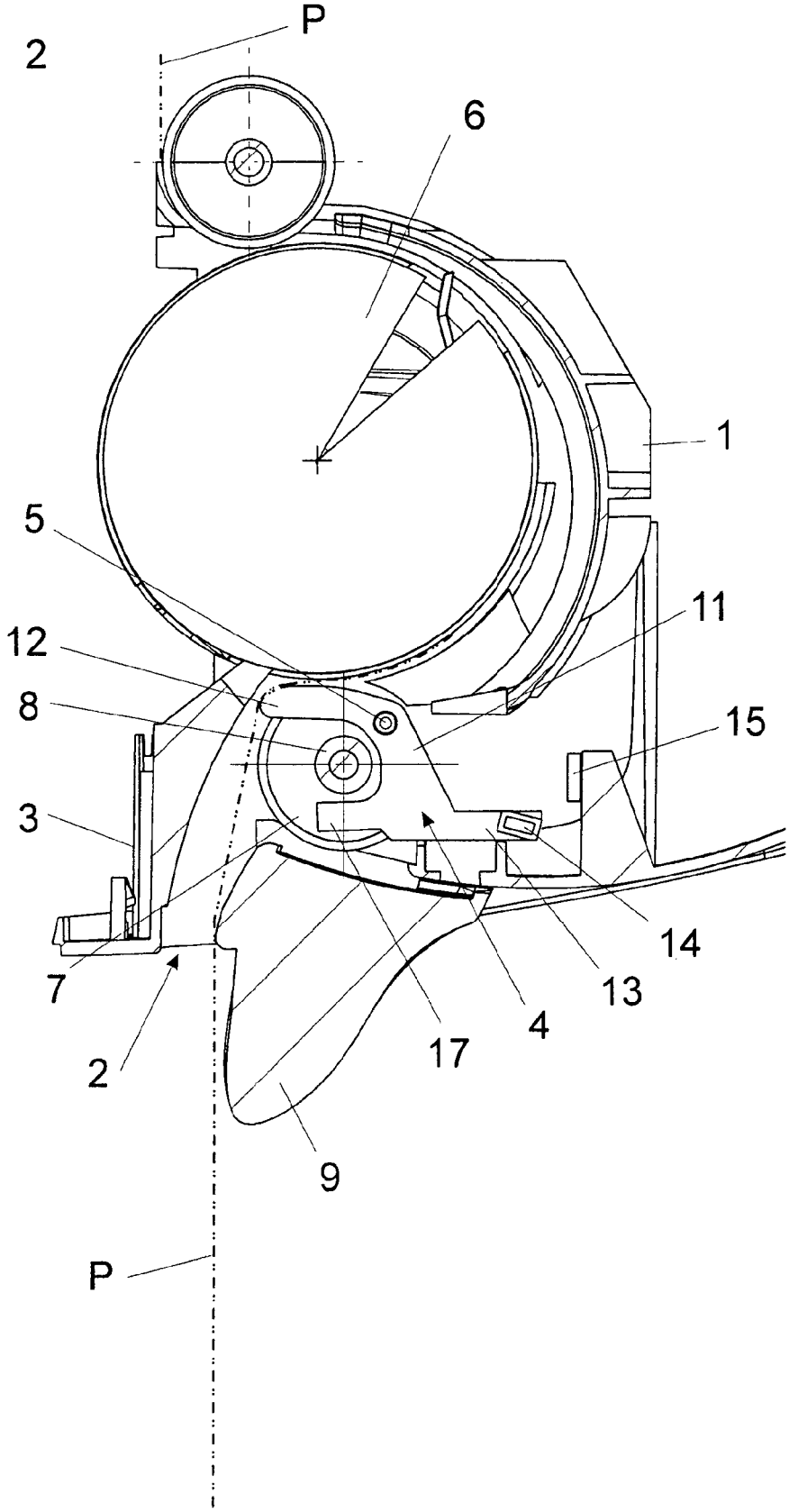
FIGS. 2 and 3 are diagrammatic, detailed side views of a discharging unit of the paper dispenser at an end of a paper-feeding operation and as a sheet is being torn off.

It is not possible to avoid the situation where a person moves into the sensing region of the sensor 3 and therefore causes the feed of a length of paper which is not removed. If the dispenser is installed at an unfavorable location, it is also possible for this to happen a number of times in succession, and therefore one or more sheets of paper hang out of the dispenser and are wasted. In order to stem this unintended consumption, the dispenser is controlled such that, at the end of the feeding operation, that is to say upon completion of a paper-dispensing cycle, the operational-standby mode is also brought to an end, i.e. as long as the length of paper P according to FIGS. 1 and 2 is hanging out of the dispenser it is not possible for any further feeding operation to take place. A switch 4 is provided in the final, tensioning-free section of the course taken by the paper, it being possible for the switch 4 to be lowered, in particular, into the surface of the discharging roller 7. FIG. 2 shows that the paper web runs in a tensioning-free manner over the switch 4 and is raised off from the circumference of the discharging roller 7 in the process.

Figure 3:
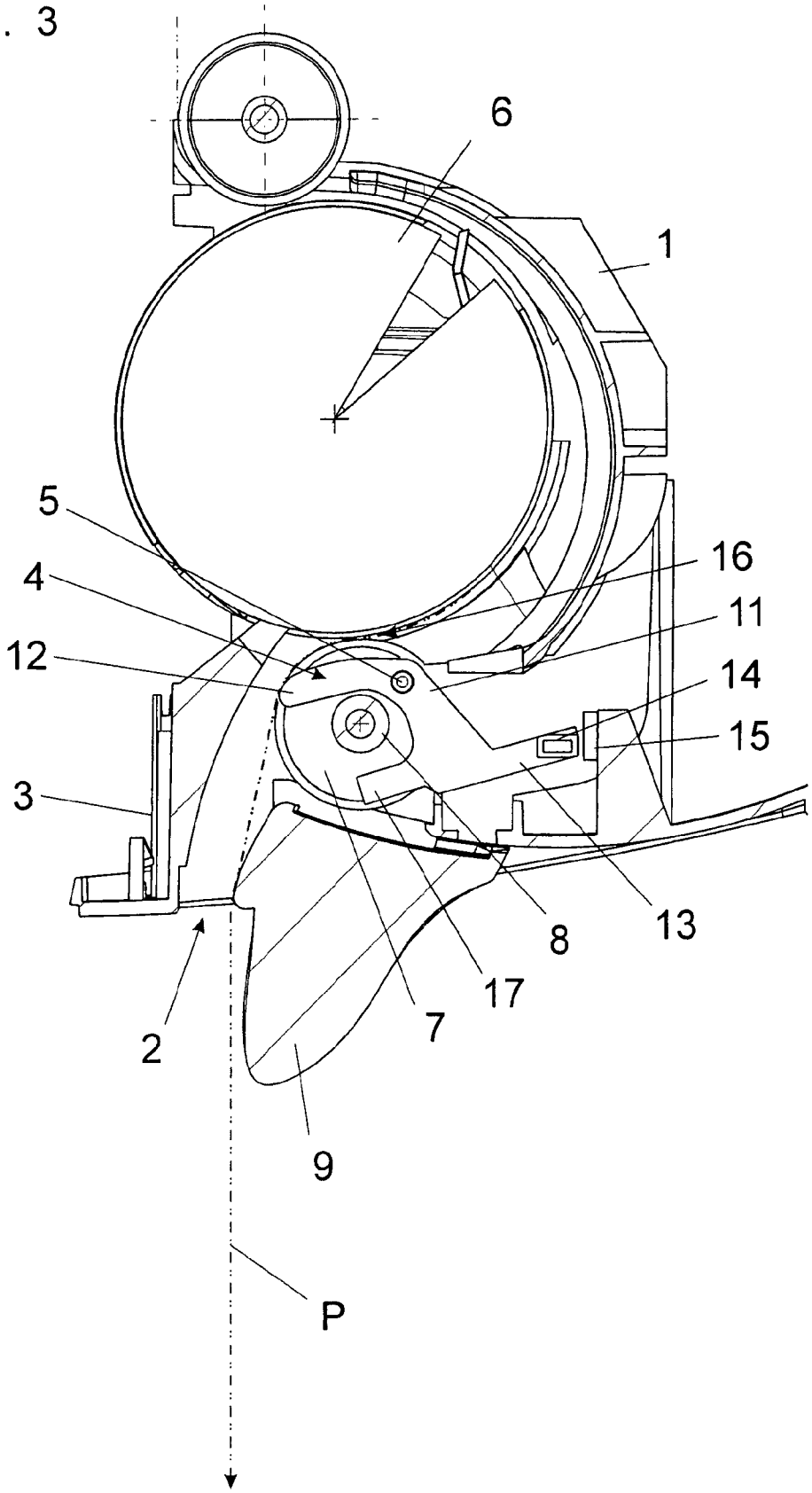
Figure 4:
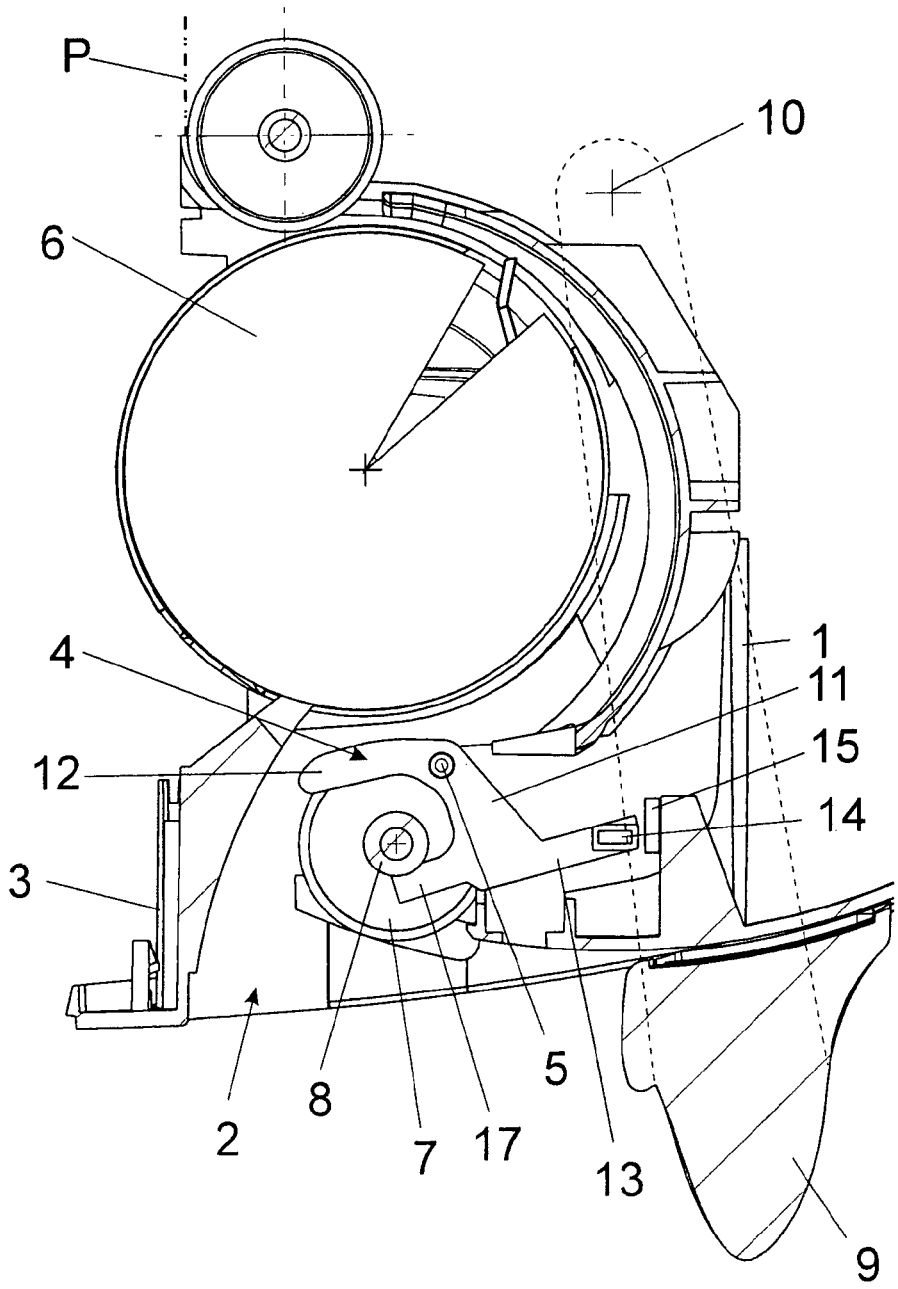
FIG. 4 is a side view of the discharging unit in an event of an emergency actuation.

In order to re-establish the operational-standby mode, it is necessary for a sheet to be torn off, this being done, according to FIG. 3, by the end of the length which is hanging down being pulled by hand. The paper P is subjected to tensioning as it is being torn off, and the switch 4, which is configured as a two-armed lever 11, pivots about a pin 5, wherein its first end 12 lowers into the discharging roller 7. The second end 13 bears a permanent magnet 14, which interacts in a contactless manner with a reed switch 15 in the housing. The lever 11 is more or less balanced, and therefore even just small tensile forces are sufficient to pivot it and thus re-establish an interrupted power supply via the reed switch 15, or interact in some other way with the at-rest control device and activate the same. It is thus the case that the dispenser is ready for the following dispensing cycle only once the switch 4 has been actuated.

If there is a problem with the electronic or electrical part of the dispenser, or if there is a paper jam, then the dispenser has been provided with an emergency-actuation lever 9, which can be pivoted about the axis 10. The pivoting movement separates a motor drive, via the discharging roller 7, from the discharging unit and rotates the blade roller 6 directly. It is also possible for the switch 4 to be reset if its lever 11 has a protrusion 17 and the discharging roller 7 is lowered during the pivoting movement of the emergency-actuation lever 9. In this case, a part 8 of the discharging roller 7 comes into contact with the protrusion 17 of the lever 11 and the switch 4 is likewise actuated, as can be seen from FIG. 4.

The invention claimed is:

1. A dispenser for dispensing a sheet of paper from a supply of paper, the dispenser comprising:

an electric drive;

a dispenser body having an underside with a discharging gap (2) formed therein;

a sensor, which, upon sensing a person, causing said electric drive to feed a length of paper out of said discharging gap, and therefore a paper sheet can be torn off by hand;

a switch actuated by virtue of the paper sheet being torn off and an actuation of said switch sets the dispenser into an operational-standby mode to feed a further length of paper;

a discharging roller disposed in a vicinity of said discharging gap and having a circumferential surface, said switch assigned to said discharging roller and said switch projecting in a lowerable manner out of said circumferential surface of said discharging roller;

a reed switch;

a permanent magnet interacting in a contactless manner with said reed switch; and said switch having a two-armed lever, said two-armed lever having a first end projecting into a path taken by the paper sheet on said discharging roller and a second end disposed on said permanent magnet.

2. The dispenser according to claim 1, further comprising an emergency-actuation lever, which can bypass a motor drive mechanically, wherein said switch can be actuated by means of said emergency-operation lever.

* * * * *